US009824871B2

(12) United States Patent
Senko et al.

(10) Patent No.: US 9,824,871 B2
(45) Date of Patent: Nov. 21, 2017

(54) HYBRID MASS SPECTROMETER AND METHODS OF OPERATING A MASS SPECTROMETER

(71) Applicant: Thermo Finnigan LLC, San Jose, CA (US)

(72) Inventors: Michael W. Senko, Sunnyvale, CA (US); Justin Blethrow, Oakland, CA (US); Shannon Eliuk Dixon, San Jose, CA (US); Tonya Second, Corona, CA (US); Vladimir Zabrouskov, Belmont, CA (US); Eric Hemenway, Milpitas, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/776,910

(22) PCT Filed: Mar. 7, 2014

(86) PCT No.: PCT/US2014/021962
§ 371 (c)(1),
(2) Date: Sep. 15, 2015

(87) PCT Pub. No.: WO2014/150040
PCT Pub. Date: Sep. 25, 2014

(65) Prior Publication Data

US 2016/0035549 A1 Feb. 4, 2016

Related U.S. Application Data

(60) Provisional application No. 61/793,222, filed on Mar. 15, 2013.

(51) Int. Cl.
*H01J 49/00* (2006.01)
*H01J 49/06* (2006.01)

(52) U.S. Cl.
CPC ..... *H01J 49/0031* (2013.01); *H01J 49/005* (2013.01); *H01J 49/009* (2013.01); *H01J 49/061* (2013.01)

(58) Field of Classification Search
None
See application file for complete search history.

(56) References Cited

U.S. PATENT DOCUMENTS 5,811,800 A * 9/1998 Franzen ..... H01J 49/422 250/282
6,753,523 B1 6/2004 Whitehouse et al.
6,833,544 B1 12/2004 Campbell et al.
9,698,002 B2 * 7/2017 Hauschild ..... H01J 49/4265
(Continued)

FOREIGN PATENT DOCUMENTS

WO WO 2008/080604 A2 7/2008

*Primary Examiner* — Michael Logie
(74) *Attorney, Agent, or Firm* — Charles B. Katz

(57) ABSTRACT

A hybrid mass spectrometer design and architecture, and methods of operating mass spectrometers are disclosed. According to one operating method, an analysis time is determined for each one of a plurality of ion species to be analyzed in an ordered sequence, and an injection time is calculated for at least some of the ion species based on an analysis time of a preceding ion species in the ordered list. The method enables more efficient utilization of analyzer time.

1 Claim, 12 Drawing Sheets

(56) References Cited

U.S. PATENT DOCUMENTS

| | | | | |
|---|---|---|---|---|
| 2004/0217272 | A1* | 11/2004 | Horning | H01J 49/4265 250/282 |
| 2007/0158546 | A1 | 7/2007 | Lock et al. | |
| 2008/0048113 | A1* | 2/2008 | Franzen | H01J 49/4225 250/292 |
| 2008/0203288 | A1* | 8/2008 | Makarov | H01J 49/004 250/282 |
| 2008/0224033 | A1* | 9/2008 | Makarov | H01J 49/04 250/287 |
| 2010/0314538 | A1* | 12/2010 | Makarov | H01J 49/425 250/283 |
| 2013/0327934 | A1* | 12/2013 | Makarov | H01J 49/425 250/282 |

* cited by examiner

HYBRID MASS SPECTROMETER AND METHODS OF OPERATING A MASS SPECTROMETER

CROSS-REFERENCE TO RELATED APPLICATION

This application claims the priority benefit of U.S. provisional patent application No. 61/793,222 for "Hybrid Mass Spectrometer and Methods of Operation Thereof" by Senko, et al., the entire disclosure of which is incorporated herein by reference.

FIELD OF THE INVENTION

The present invention relates generally to mass spectrometry, and more particularly to a novel hybrid mass spectrometer and methods for operating mass spectrometers to optimize mass analyzer usage.

BACKGROUND

In proteomics and other fields of research employing mass spectrometry as an analytical technique, there is increasing demand for high-throughput analysis of large numbers of peptides or other substances in a complex sample. Such analyses are highly beneficial, for example, in connection with biomarker studies that seek to identify differentially expressed proteins between control and diseased samples. Hybrid mass spectrometers, which utilize two or more mass analyzers of different types, have become a popular and valuable tool for quantitative and qualitative analysis of complex biological samples. Hybrid mass spectrometers offer the advantage of joining the capabilities and advantages of different mass analyzer types, thereby avoiding the performance tradeoff associated with use of a single type of mass analyzer. For example, the Orbitrap Elite mass spectrometer, available from Thermo Fisher Scientific, combines the high sensitivity, rapid scan speed and $MS^n$ (multiple-stage isolation and dissociation) capability of a two-dimensional quadrupole ion trap mass analyzer with the high resolution/accurate mass performance of an Orbitrap electrostatic trap mass analyzer.

Hybrid mass spectrometers may utilize parallel operation of the different mass analyzers in order to produce more and richer data characterizing the sample. In parallel acquisition techniques, each of the two or more mass analyzers is operated independently and concurrently to perform ion injection, optional ion manipulation (e.g., isolation and fragmentation), and mass spectral acquisition. Parallelized acquisition techniques may be operated in a data-dependent fashion, in which mass spectral data acquired in one of the analyzers is processed in real time to adapt "on the fly" the operation of the mass spectrometer. For example, a commonly employed data-dependent approach involves the selection of precursor ion species for MS/MS or $MS^n$ analysis based on the intensities of ion species observed in a full MS spectrum. This approach is sometimes referred to colloquially as "Top N" MS/MS analysis. When implemented in a hybrid mass spectrometer, Top N MS/MS analysis may be conducted by using a first mass analyzer to acquire the full MS spectrum and a second mass analyzer to perform MS/MS analysis of selected precursor ion species. In this manner, the acquisition of a full MS spectrum for identification of high-intensity ions may be performed concurrently with MS/MS analysis of precursor ion species identified in a previously acquired MS spectrum.

While the use of hybrid mass spectrometers, parallel mass analyzer operation and data-dependent analysis has provided significant gains in performance, the ability to rapidly and efficiently analyze complex samples is limited by the design and available modes of operation of prior art mass spectrometer systems. Typically, hybrid mass spectrometers utilize mass analyzers of different types (e.g., an electrostatic mass analyzer and an ion trap mass analyzer) having different analysis cycle times (i.e., the time required to fill the mass analyzer to a target population, to cool the ions and perform any desired manipulations, and to separate and detect the ions to generate a mass spectrum). The mismatch between analysis cycle times may result in "dead time", wherein one of the mass analyzers remains inactive until the completion of an analysis cycle by the other mass analyzer. Inefficient utilization of mass analyzers may be exacerbated by mass spectrometer architectures that do not allow one of the mass analyzers to be filled until the other has completed a mass spectral scan.

Against this background, there is a need in the art for instrument designs and modes of operation that provide enhanced efficiency of mass analyzer utilization and the capacity for greater high-throughput analysis, particularly of complex biological samples.

SUMMARY

In accordance with a first aspect of the invention, a hybrid mass spectrometer is provided having an ion source, a mass selector such as a quadrupole mass filter, a collision cell having a multipole constructed from elongated electrodes extending between first and second ends, and first and second mass analyzers. The collision cell, which receives ions via its first end from the mass selector, is coupled to a controller programmed with logic for selectively releasing ions accumulated within the collision cell either through the first end to a first mass analyzer, or through the second end to a second mass analyzer. Neither the first nor second mass analyzer is positioned in the ion path extending from the ion source to the collision cell, thereby enabling accumulation of ions in the collision cell while the first and second mass analyzers are operating.

In accordance with another aspect of the invention, a method of operating a hybrid mass spectrometer having first and second mass analyzers of different types is provided. The method includes repeating a sequence of steps, which sequence includes selecting precursor ion species for MS/MS analysis based on a preceding MS spectrum acquired at the first mass analyzer, acquiring at a second mass analyzer a plurality of MS/MS spectra each corresponding to a different one of the selected precursor ion species, and acquiring a complete MS spectrum of a new group of ions at the first mass analyzer concurrently with the acquisition of the MS/MS spectra at the second mass analyzer. In a particular implementation of this method, the repeated sequence of steps includes determining a number of MS/MS scan events that can be determined within a defined interval, and terminating the acquisition of MS/MS spectra after the determined number of scan events has occurred. The defined interval may be representative of a time required to complete the concurrently executed complete MS scan at the first analyzer, or may be specified by the instrument operator.

In accordance with yet another aspect of the invention, a method is provided for performing data-dependent MS/MS analysis in a mass spectrometer. In this method, an MS spectrum is acquired of sample ions, which is used to identify a group of precursor ion species for MS/MS analysis. Rather than executing the MS/MS scans in order of the precursor ions' intensities, as is typically done in the prior art, the precursor ion species are sorted by at least one of charge state and mass-to-charge ratio to produce an ordered list, and the MS/MS spectra are acquired in the sequence of the ordered list. The step of identifying a group of precursor ion species for MS/MS analysis may include limiting the group to one charge state per precursor ion in order to reduce the acquisition of redundant low-quality spectra and allow more time for analysis of a greater number of precursor ions. This method may be particularly beneficial when used in combination with mass spectrometers that have multiple available fragmentation modes, e.g., electron transfer dissociation (ETD) and collisionally activated dissociation (CAD).

In accordance with a still further aspect of the invention, a method is provided for performing mass spectrometry analysis in an instrument having an ion store for accumulating ions for subsequent mass analysis, and a mass analyzer arranged and configured to acquire mass spectra concurrently with the accumulation of ions in the ion store. The method includes setting ideal and minimum target populations, identifying a group of ion species to be analyzed in an ordered sequence, determining an analysis time (the time required to complete a mass analysis scan for acquisition of a mass spectrum) for at least some of the ion species, and calculating an injection time for at some of the ion species, based on the analysis time of a preceding ion species in the ordered sequence (i.e., the ion species that is being analyzed while the other ion species is being accumulated). The calculated injection time yields a population of the corresponding ion species that lies between the set ideal and minimum target populations.

In accordance with another aspect of the invention, a method is provided for performing mass spectrometry analysis in an instrument having an ion store for accumulating ions for subsequent mass analysis, and a mass analyzer arranged and configured to acquire mass spectra concurrently with the accumulation of ions in the ion store. The method includes steps of identifying a group of ion species to be analyzed, determining associated injection and analysis times for each ion species, creating an ordered list of ion species by matching the analysis time associated with a given ion species to the injection (accumulation) time of another ion species, and repeatedly performing a sequence of accumulating in the ion store the Nth ion species on the ordered list while mass analyzing the N−1th ion species in the mass analyzer.

In accordance with still another aspect of the invention, a method is provided for performing mass spectrometry analysis in an instrument having an ion store for accumulating ions for subsequent mass analysis, and a mass analyzer arranged and configured to acquire mass spectra concurrently with the accumulation of ions in the ion store. The method includes steps of identifying a group of ion species to be analyzed and organizing the group into an ordered list, determining injection times corresponding to the ion species, and performing repeated operations of concurrently accumulating in the ion store the Nth ion species on the ordered list and mass analyzing the N−1th ion species on the ordered list. A mass analysis parameter employed for mass analyzing the N−1th ion species (e.g., a transient duration for analysis in an electrostatic trap, or a scan rate for analysis in a quadrupole ion trap) is adjusted such that the analysis time of an ion species is matched to the injection time of the subsequent ion species on the list, which is undergoing accumulation concurrently with the analysis of the Nth ion species.

DESCRIPTION OF EMBODIMENTS

Figure 1:
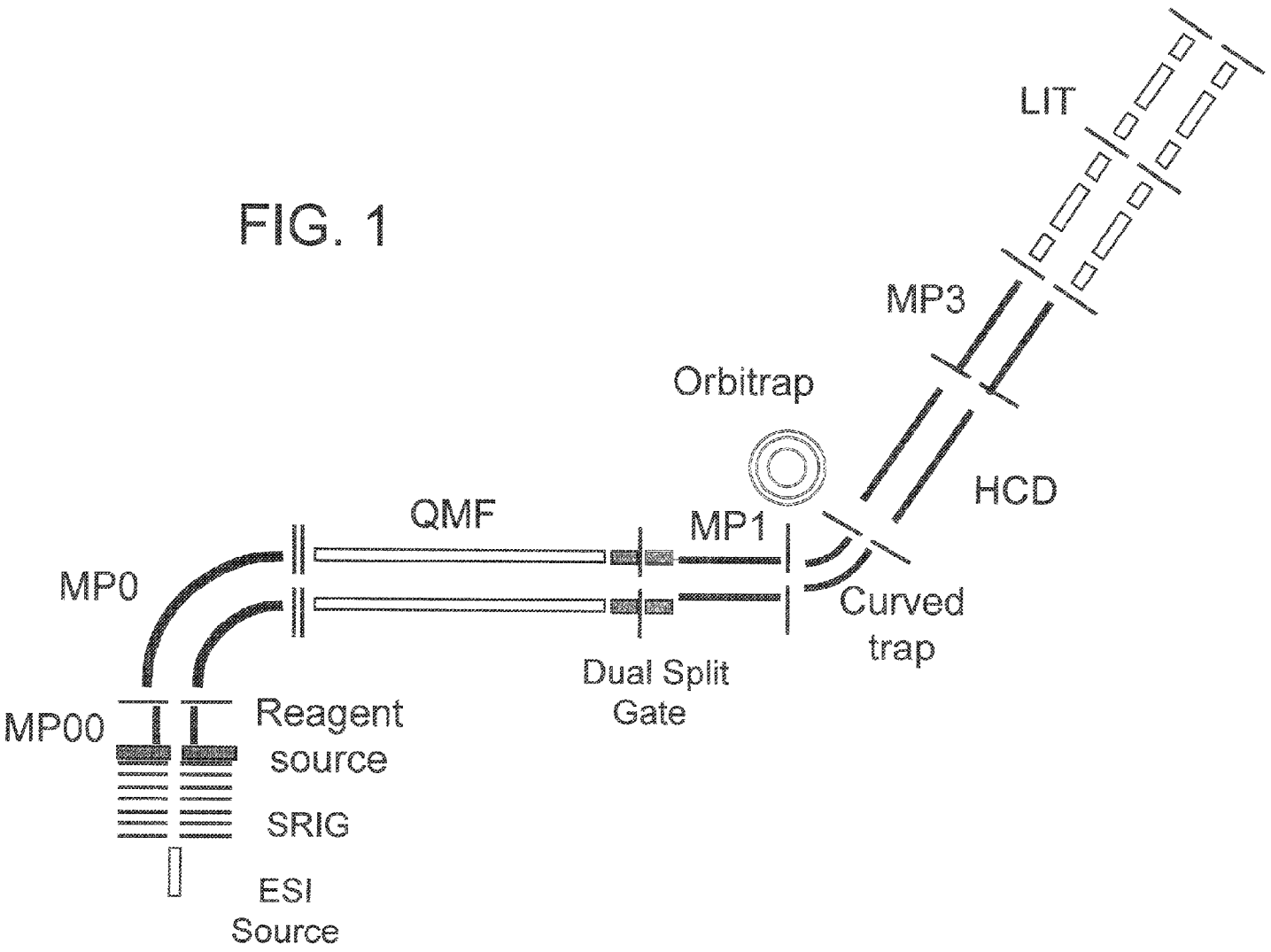
FIG. 1 is a symbolic diagram of a mass spectrometer arranged and configured in accordance with an illustrative embodiment.

FIG. 1 depicts a mass spectrometer constructed in accordance with an embodiment of the invention. The mass spectrometer includes three different types of mass analyzers, consisting of a quadrupole mass filter (QMF), an Orbitrap (orbital electrostatic trap) mass analyzer, and a linear (two-dimensional) quadrupole ion trap mass analyzer (LIT). In operation, ions generated by an ion source (which may be an electrospray source, as depicted, but may alternately take the form of any other suitable structure for producing sample ions in a pulsed or continuous manner) are conveyed through a heated ion transfer tube, which assists in the evaporation of residual solvent, into a stacked ring ion guide (SRIG) of the type described in U.S. Pat. No. 7,514,673.

Application of RF voltages to the SRIG electrodes establishes an RF field that confines and focuses ions as they traverse the SRIG. The ions then pass through a short RF multipole ion guide MP00 and are conveyed through a curved multipole ion guide MP0 into the QMF. Curved multipole MP0 is preferably provided with structures for establishing a DC gradient along the central axis to assist in the transport of ions to the QMF. The QMF, which is conventionally constructed from four rod electrodes having hyperbolic surfaces, is operable to selectively transmit ions with a desired range of mass/charge ratios (m/z's); the transmitted m/z range is set by adjusting the amplitudes of the RF and resolving DC voltages applied to the rod electrodes, as is known in the art.

The ion stream emerging from the QMF is gated by a split gate lens into discrete packets for analysis by the Orbitrap or LIT analyzer. The ion packets pass through another RF multipole ion guide MP1 and into a curved ion trap, which is constructed from rod electrodes curved concavely toward the entrance to the Orbitrap analyzer. This curved ion trap may be similar to the curved ion trap (referred to sometimes as a "C-trap") currently in use in commercially available Orbitrap instruments. Ion packets entering the curved ion trap are released through the opposite end to the HCD cell (also referred to as the "collision cell" or the "Ion routing multipole" or IRM), which operates to accumulate and optionally fragment the entering ions. The HCD cell takes the form of a multipole structure extending axially from a first to a second end, in which ions may be axially confined by adjusting voltages applied to the end lenses. The HCD cell may be, but is not necessarily, operated to produce fragmentation of ions delivered thereto. If fragmentation is desired, then the ions are accelerated into the HCD at the desired collision energy by adjusting the DC offset between the curved ion trap and/or other components upstream of the HCD cell; alternatively, if the ions are to remain intact, the DC offsets are adjusted to maintain the energies of the entering ions to a level at which no or minimal fragmentation occurs. The HCD cell may be filled with nitrogen, argon, or other suitable collision gas to cause fragmentation and/or assist in trapping.

Depending on the desired mode of analysis, ions accumulated (and optionally fragmented) within the HCD cell are passed either through its first end to the curved ion trap and thereafter to the Orbitrap analyzer, or through its second, opposite end to multipole MP3 and thereafter to the LIT analyzer. The direction in which ions are axially ejected from the HCD cell may be controlled by adjusting DC offsets applied to the end lenses and/or adjacent components, as well as by establishing an axial field (by means of auxiliary electrodes or other techniques or structures known in the art) that drives the ions toward the desired end. When analysis by the Orbitrap analyzer is desired, the ion packet passes through the first end and is accumulated and confined within the curved ion trap. The ion packet is then orthogonally ejected from the curved ion trap and focused to the entrance of the Orbitrap mass analyzer. The design and principle of operation of the Orbitrap mass analyzer is well-known in the art and hence need not be described herein. Generally described, the Orbitrap is an electrostatic trapping analyzer constructed from inner and outer electrodes, which establish a hyperlogarithmic field in which ions under harmonic motion along the longitudinal axis, the frequency of which is dependent on the square root of the m/z of the trapped ions. A mass spectrum of the trapped ions is acquired by detection of an image current on the split outer electrode, and the resultant signal (referred to as a transient) is converted to the frequency domain by a Fourier Transform and further processed to yield the mass spectrum.

Notably, the architecture of the mass spectrometer of FIG. 1, and in particular the placement of the HCD cell relative to the Orbitrap and LIT analyzers, enables ions to be scanned (i.e., mass analyzed) in either or both mass analyzers while ions are accumulated in the HCD cell for the next series of scans. This parallelization of ion accumulation and analysis enables more efficient utilization of the mass analyzers and provides the ability to acquire more (or higher quality) data per unit time, relative to prior art instruments.

The LIT analyzer may take the form of the dual cell ion trap described in U.S. Pat. No. 7,692,142, which is currently being sold by Thermo Fisher Scientific as the Velos™ linear ion trap. In this analyzer, two linear trapping cells are placed adjacent one another and separated by an inter-cell ion optic or lens, which governs the flow of ions between the traps. The first ion cell (positioned proximate multipole MP3) is maintained at a pressure optimized for efficient trapping and fragmentation, while the second cell is maintained at a pressure optimized for mass analysis (which may be performed by mass sequentially ejecting ions to detectors located adjacent to ejection slots formed in the electrodes, in the manner known in the art). Each cell is constructed from four rod electrodes arranged in parallel around a central axis, with each rod electrode being segmented and having a hyperbolic-shaped surface facing the central axis. In a typical sequence, ions are initially trapped in the first cell, and the trapped ions are optionally subjected to one or more stages of isolation (in which all ions outside of a selected m/z range or ranges are ejected) and collisionally induced fragmentation (in which ions are energetically collided, via resonant excitation, with atoms or molecules of a collision gas added to the LIT interior). The resultant product ions (or precursor ions, if no fragmentation is performed) are then transferred to the second cell for acquisition of a mass spectrum. Inter-cell transfer of ions is effected by adjusting voltages applied to the inter-cell lens and the electrodes of the first and/or second cells, to thereby create a potential gradient that drives ions toward the second cell; alternatively, auxiliary electrodes may be employed to establish axial fields for this purpose.

For certain experiments, it may be beneficial to perform one or more stages of isolation and fragmentation in the LIT analyzer (taking advantage of its MS' capabilities) followed by mass analysis of the resultant product ions in the Orbitrap analyzer (taking advantage of its high resolution/accurate mass capabilities). In this case, the product ions are ejected from the LIT analyzer through the entrance end of the first cell, and pass through the multipole ion guide MP3 and the HCD cell into the curved ion guide for accumulation thereby, with subsequent ejection to the Orbitrap analyzer for mass analysis. If an additional stage of fragmentation is desired, then ions ejected from the LIT analyzer are accelerated, by adjustment of DC offsets or by imposition of axial fields, to energies suitable to cause fragmentation within the HCD cell. Collisionally induced fragmentation within the HCD cell may offer certain advantages or opportunities relative to in-trap collisionally induced fragmentation, due to the wider range of collision energies available within the HCD cell and the lower low-mass cutoff associated with the HCD cell. In a variation of the foregoing experiment, ions may be ejected from the LIT analyzer and accelerated into the HCD cell for fragmentation therein. The resultant product ions may then be returned (by adjustment of offsets or imposition of an axial field) to the LIT analyzer for acquisition of a mass spectrum.

The LIT analyzer may also be utilized to produce product ions via reactions with reagent ions, for example by electron transfer dissociation (ETD) or proton transfer reaction (PTR). For such experiments, reagent ions and sample (analyte) ions are sequentially injected into the LIT analyzer. In the ETD example, ETD reagent ions, such as fluoranthene anions, are generated in a reagent ion source integrated into the exit lens of the SRIG. Such an ion source may utilize a Townsend discharge to ionize the fluoranthene molecules. The ETD reagent ions and sample ions are delivered, in turn, through the upstream components into the LIT analyzer (since the polarities of the sample and reagent ions are opposite, the DC offsets applied to the components need to be adjusted to provide the appropriate gradients to drive ion flow). The sample and reagent ions are simultaneously trapped within the LIT analyzer and allowed to mix, following an initial stage of separate confinement. The simultaneous confinement of oppositely charged ions within the LIT analyzer may be achieved, for example, by application of oscillatory voltages to the end lenses or sections, as described in U.S. Pat. No. 7,026,613. ETD product ions, resulting from the reaction of the reagent and sample ions, may then be mass analyzed in either the LIT analyzer or the Orbitrap mass analyzer. Such mass analysis may be preceded by one or more additional stages of fragmentation or reaction, which may occur within the LIT analyzer or the HCD cell. The reagent ion source may also be utilized to generate calibrant ions for use in calibrating the m/z measured by the mass analyzers (i.e., as "lock mass" ions).

Figure 6:
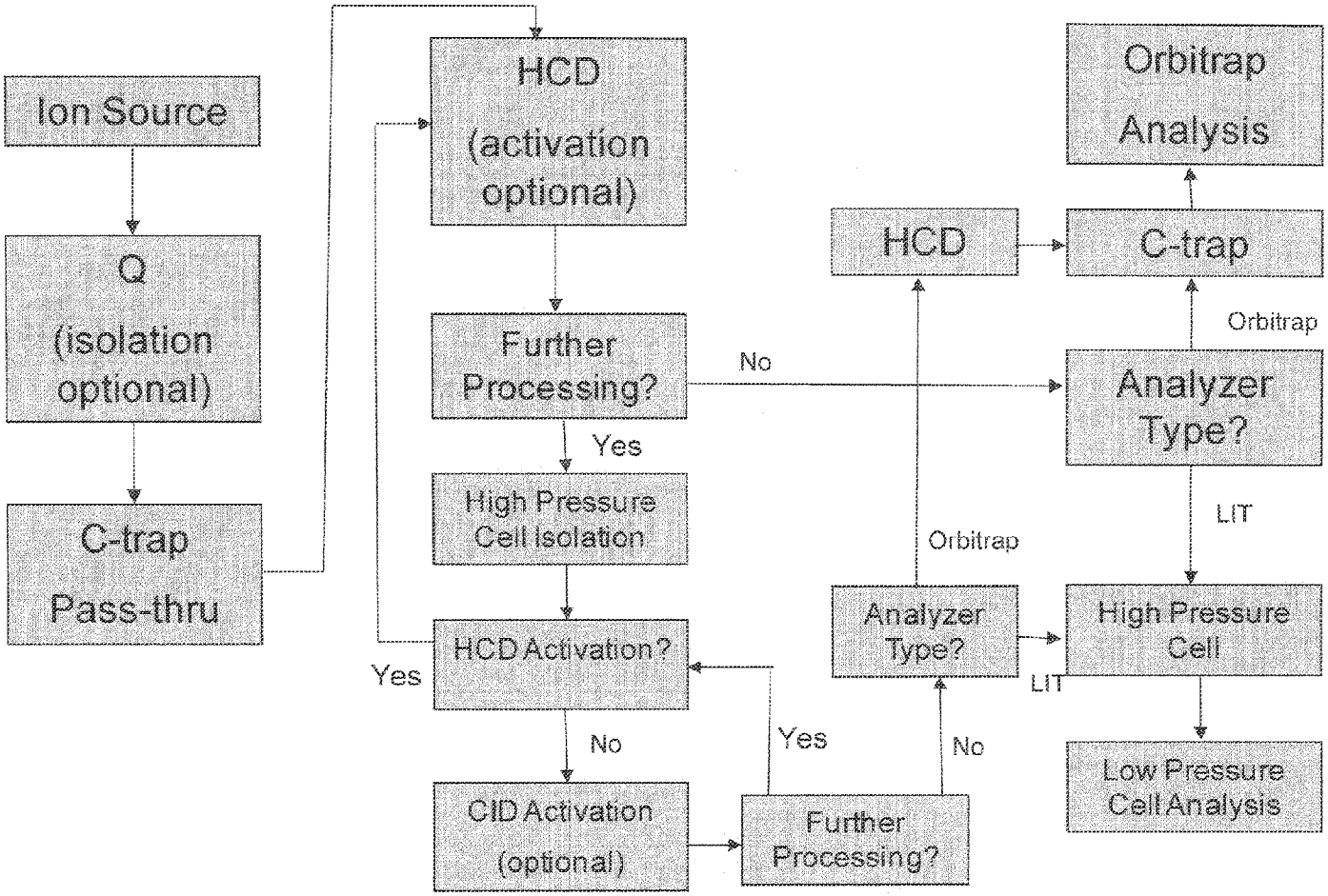
FIG. 6 is a flowchart showing available sequences of operations in the FIG. 1 mass spectrometer.

FIG. 6 further discloses sequences of operations and the associated ion flowpaths that may be achieved within the mass spectrometer. It should be noted that this flowchart, as well as the description provided above, are intended to illustrate the capabilities of the mass spectrometer, and that the mass spectrometer may be employed for other operations or combinations thereof which are not depicted or discussed.

While not depicted in the drawing, the components of the mass spectrometer are located within a set of vacuum chambers, which are evacuated through associated ports by a pumping system to the requisite vacuum pressures.

The various components of the mass spectrometer operate under the control of and in communication with a controller (not depicted), which is provided with hardware and/or software logic for executing the desired functions and operations associated with performing mass spectrometry analysis. The controller forms part of a control and data system also not depicted), which also stores and processes data generated by the Orbitrap and LIT analyzers. The control and data system will typically be distributed across several physical devices, including processors and circuitry embedded in the mass spectrometer instrument as well as one or more general purpose computers that are connected to the mass spectrometer via a communications link, and will include a combination of hardware, firmware and software logic, as well as memory and storage. The control and data system is also provided with a graphical user interface for accepting operator input (e.g., operational parameters and specified methods) and for displaying results.

According to variations of the mass spectrometer architecture, other types of mass analyzers may be substituted for the LIT and Orbitrap mass analyzers; for example, a time-of-flight, FTICR, or other analyzer capable of acquiring mass spectra at relatively high resolution and mass accuracy may be substituted for the Orbitrap mass analyzer.

The architecture of the mass spectrometer described above, and in particular its ability to perform a variety of functions in parallel fashion, offers opportunities to implement experimental methods that are not available (or may be available at reduced performance or with lesser benefits) in connection with prior art instruments. Several of these methods are discussed below. It should be noted, however, that the following methods should not be construed as being limited to use with the FIG. 1 mass spectrometer, and instead may be beneficially employed with any number of instruments of various designs and configurations.

It is further noted that the methods described below will typically be implemented as a set of program instructions, encoded in software or hardware form, that are stored or accessed by the instrument controller and executed by one or more processors of the controller or control and data system, preferably in an automated fashion, and with no or minimal user input.

Optimized Scan Interleaving

Figure 2A:
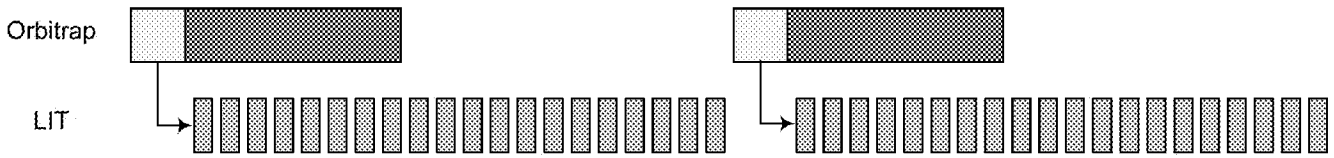
FIGS. 2A-2C illustrate sequences of scan events occurring in first and second mass analyzers of a hybrid mass spectrometer, as undertaken in the prior art.
Figure 2B:
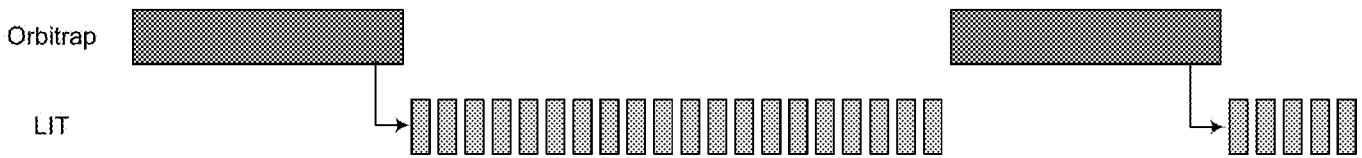
Figure 2C:
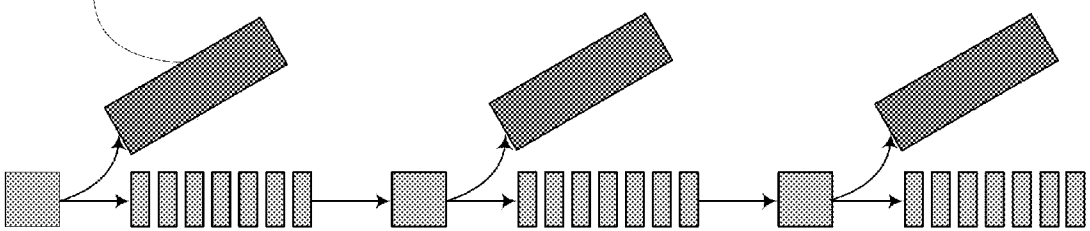
FIG. 2C (PRIOR ART)

Prior art data acquisition approaches for a hybrid instrument composed of LIT and Orbitrap mass analyzers are shown in FIGS. 2A-2C. In the first (and most common) case (FIG. 2A), the instrument is operated in 'parallel' acquisition mode, in which LIT based scan events (lower boxes) overlap in the time domain with acquisition of a high resolution FTMS MS1 spectrum (an MS1 spectrum obtained by Fourier Transform of the transient signal produced by the detection arrangement of the Orbitrap mass analyzer, depicted in the upper boxes). This is made possible through the use of "Preview Scan" mode, wherein a relatively low resolution FTMS spectrum (~12 k resolution) is produced without termination of FTMS transient acquisition, and the data from this low resolution spectrum is used to generate a list of target ions for MS2 analysis in the LIT analyzer. In the second major mode of operation (FIG. 2B), there is simply no parallel acquisition and LIT MS2 events are based on high resolution FTMS data after acquisition of a full transient. Neither data acquisition mode is truly parallel; in the case of "parallel acquisition" what we really have is a branching acquisition mode, where the high resolution FTMS branches terminate and the information contained therein is not used to inform data-dependent decisions (FIG. 2C).

Each of the prior art data acquisition approaches compromises the efficiency and/or capability of one or both of the mass analyzers. In the case of the use of "Preview Scan" data, precursor ions are targeted based on relatively low resolution MS1 data, leading to the likely omission of suitable precursors. The LIT performs relatively efficiently in this mode, as it is able to operate for most of the time that the FTMS is acquiring a transient, but must still wait approximately 200 ms for acquisition of the "Preview Scan". In the completely serial mode of operation, precursor targeting is based on high resolution FTMS data, but the LIT is idle during acquisition of the full transient, leading to highly inefficient LIT usage.

Against this background, a novel alternative mode of operation is disclosed that substantially resolves these inefficiencies and allows both analyzers to run near 100% of the time without compromising the FTMS resolution used for data-dependant decisions. This proposed mode of operation contains several departures from the prior art approaches.

Figure 3:
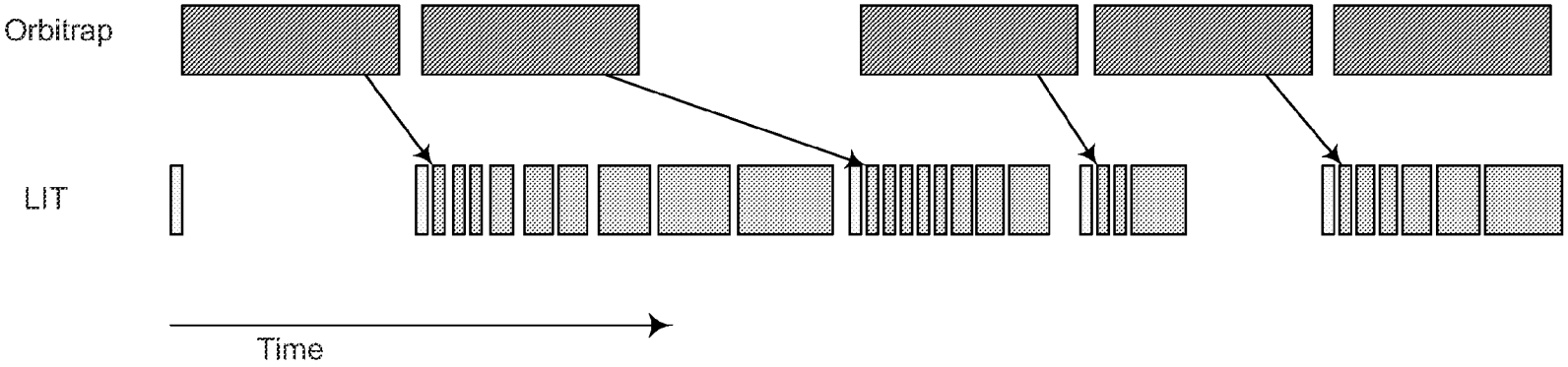
FIG. 3 illustrates a sequence of scan events occurring in first and second mass analyzers of a hybrid mass spectrometer, performed in accordance with an embodiment of the present invention.

The first of these is shown in FIG. 3, and involves basing MS2 (i.e., MS/MS) events on previously completed MS1 spectra. In this scenario, data acquisition begins with the performance of an LIT MS1 scan (lighter shaded boxes); this scan is used as an AGC pre-scan for the following FT MS1 scan and is also used for predictive AGC calculation of any pending MS2 fill times (as is known in the mass spectrometry art, AGC, short for automatic gain control, refers to the calculation of optimal filling or injection time (IT) of trapping mass analyzers using ion flux rates determined from a previous scan). The term injection time (IT) denotes a duration of accumulation of ions for later analysis; this accumulation may be effected either in an analyzer, or in an ion store (e.g., the collision cell of the FIG. 1 mass spectrometer) which subsequently releases the ions to the mass analyzer. In the first iteration, there are no pending MS2 events, so the scan is used only for FTMS AGC calculation. Once one (or more) FTMS scans have been completed (upper boxes), the resulting high-resolution MS1 is used to select precursors for MS2 analysis. Prior to their analysis, the next LIT MS1 spectrum is performed to predict IT values for these pending MS2 scans and to calculate the required IT for the next FT MS1. The next FT MS1 is initiated as ions are accumulated in the HCD cell and shipped to the FT, then pending LIT MS2 scans (lower boxes) are performed. In contradistinction to the prior art, the selection of ions for MS2 scans in the LIT are identified based on information in a complete spectrum acquired in the Orbitrap (FTMS) mass analyzer. As used herein, the term "complete spectrum" denotes a spectrum derived from the set of data detected over a full acquisition period of the mass analyzer (e.g., a high-resolution scan in the Orbitrap analyzer), and specifically excludes a spectrum generated from a preview scan or similar partial scan whereby a (low-resolution, reduced-quality) mass spectrum is generated solely from data detected in the early portion of an acquisition period. In various implementations of the method, the completed spectrum may have a resolution of at least 20,000; 50,000; 75,000, 100,000 or 200,000 at a specified value of m/z (e.g., 400 Thomson).

While the approach of FIG. 3 is an improvement over the prior approaches, there is still room for optimization to improve the efficiency and performance capabilities of the two analyzers. Real world data-dependent analyses typically contain variable length sequences of MS2 events, where the maximum number performed in a cycle is a user defined constant (e.g., "Top N" experiments, where N is the maximum number of events) and scan cycles contain zero to N MS2 events, depending on the number of precursors that were detected and that also meet additional inclusion criteria, if defined. Conventionally there also exists a maximum possible MS2 event duration, composed of the mass analysis time and a user defined maximum LIT fill time ("Maximum IT"). The value assigned to the maximum IT substantially controls an inherent trade-off between overall instrument speed and sensitivity, in that a low maximum IT favors faster cycles and a high maximum IT favors sensitivity by increasing the likelihood that low-abundance precursors may be accumulated to sufficient numbers as to yield a quality MS2 spectrum.

The variability in the number and duration of MS2 events performed per cycle can lead to inefficient usage of one or both mass analyzers, where our goal for efficient usage is operation of both analyzers near 100% of the time. There exist two cases where inefficiencies can occur within the context of the approach presented in FIG. 3. In the event that MS2 events are numerous, the aggregate duration of LIT events can exceed the duration of the FT MS1 scan, leading to idle time for this analyzer; this idle time will be variable between scan cycles. In combination, this leads to erratic under-sampling of the MS1 population, compromising the utility of this information for quantitative analysis of ion species compared to the ideal case where the FTMS operates as frequently and regularly as possible. The other major inefficiency occurs when the aggregate duration of MS2 events is less than the FT MS1 length. In this case, the LIT will sit idle while the FTMS scan is completed. This is most likely to occur when precursor species are sparse and/or of very low abundance. In this scenario many of the MS2 events that occur are likely to have IT values that reach the user-defined maximum. In that case, the time the LIT spends idle would more profitably be spent using a longer IT value.

Figure 4A:
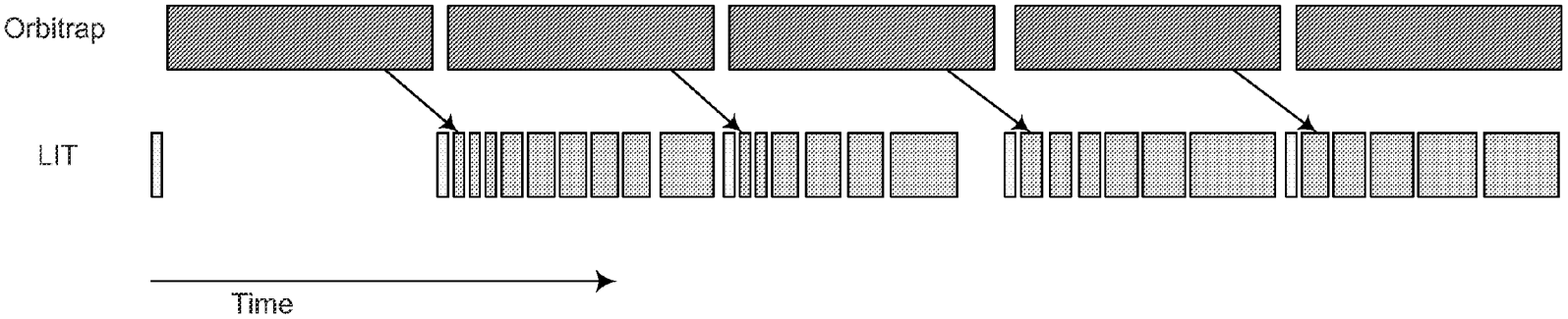
FIGS. 4A and 4B illustrate sequences of scan events occurring in first and second mass analyzers of a hybrid mass spectrometer, performed in accordance with alternative embodiments of the invention.
Figure 4B:
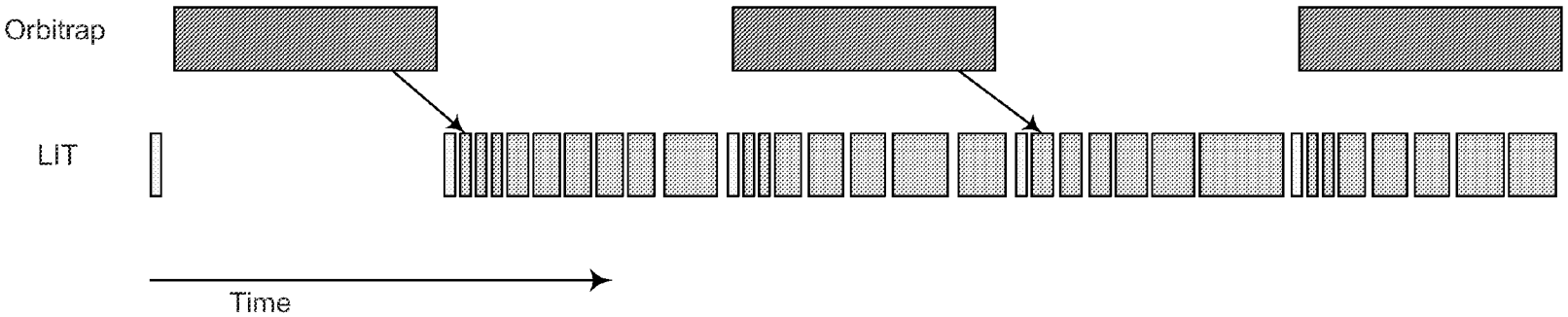

To deal with the first of these inefficiencies, wherein MS2 analysis time exceeds MS1 analysis time, an approach is proposed which is referred to as "Dynamic Top N" (depicted by FIG. 4A). In this approach, the instrument calculates the durations of pending MS2 events and determines how many of them can be performed prior to completion of the concurrent FT MS1 scan, optionally to within a definable tolerance. MS2 scans that can be completed in time are performed and their precursors are subjected to dynamic exclusion, if appropriate. Optionally, a user-definable interval is used rather than the length of the scheduled FTMS scan (as show in FIG. 4B); all MS2 scans that can be accomplished in this interval are executed. In this manner, the user is able to define a guaranteed frequency of MS1 scans so long as the interval exceeds the minimum necessary for a single FTMS scan cycle. This variant approach may be desirable if FTMS regularity is important but frequency is less so, for example to minimize file size. Note that in the case of anything but a minimal FTMS interval, an additional LIT scan must be performed for FTMS AGC.

Figure 5A:
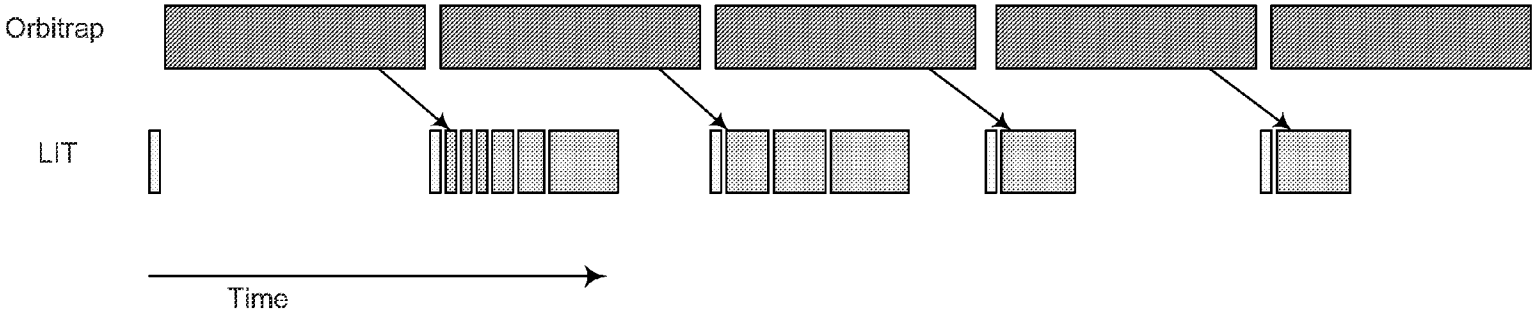
FIGS. 5A and 5B illustrate sequences of scan events occurring in first and second mass analyzers of a hybrid mass spectrometer, demonstrating in particular the effects of setting or not setting a maximum injection time value.
Figure 5B:
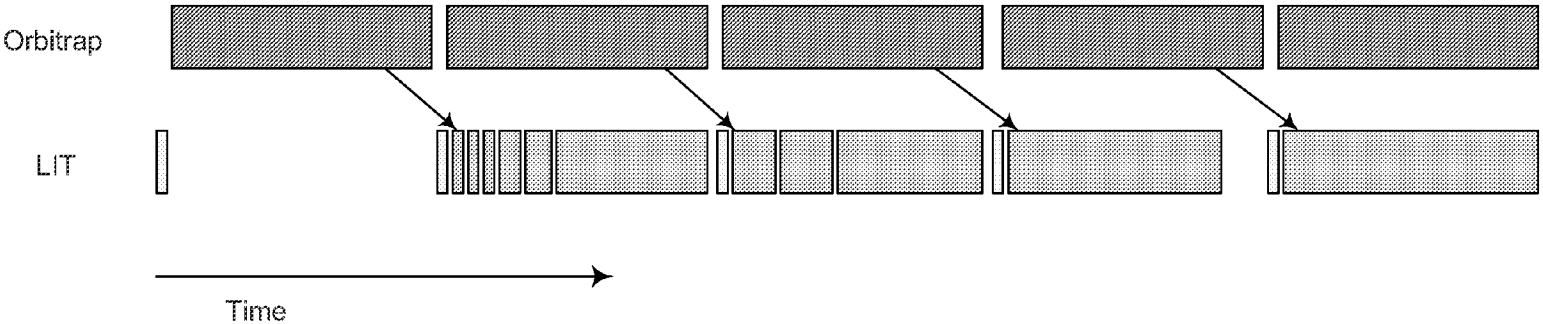

The second potential inefficiency we presented, wherein pending MS2 events do not use all available LIT time if there are only a few pending MS2 events, is also remedied through the use of "Dynamic Top N" if we discard the concept of a maximum IT entirely, or at least assume that it is set to a very large value. The reason for this is depicted by FIG. 5. In FIG. 5A, we show an example of an acquisition time where we have a low number of low-abundance precursors detected. Using a conventionally set maximum IT value, a large fraction of MS2 scans reach their maximum IT values (black boxes) and likely fail to meet their target AGC ion populations. In FIG. 5B we see what happens if we do not use a static maximum IT value under "Dynamic Top N". In this case, during calculation of MS2 durations, IT values are calculated recursively by precursor, with precursors ordered by decreasing intensity. The maximum available IT for any precursor is simply the remaining time available within the MS1 interval. MS2 IT durations are allowed to expand until they are sufficient to meet the AGC target or the maximum remaining interval fraction is reached, whichever comes first.

While the methods described above refer to MS/MS scans being performed in the LIT, it should be recognized that the methods are not limited thereto; more specifically, the method may be utilized in connection with any type or combination of data-dependent scan event performed in the LIT, including but not limited to MS3 scans, or high-resolution "zoom" scans.

Optimized Scan Execution

The architecture of the hybrid mass spectrometer described above provides the opportunity to pipeline stages of scan execution. In particular, the initial accumulation of ions (e.g., in the collision cell) for scan N can be done at the same time the ions of scan N 1 (i.e., the immediately preceding scan) are being analyzed. Since these are the two most time consuming events in the scan process, this provides a significant reduction in execution time. Ignoring the stages of the scan that cannot be pipelined, a maximum 2× reduction in scan time can be had, but only when the time required for injection (i.e., ion accumulation) is the same as the time required to analyze the prior batch of ions.

For example, consider a series of scans from 500-1500 m/z at a scan rate of 33 kDa/sec, which results in 30 msec being spent on ion analysis. If the flux of ions from the source is such that injection of ions to the user requested target takes 30 msec, pipelining of injection and analysis will result in twice as many scans being executed in the same amount of time.

Now consider the case where the analysis takes the same 30 msec, but the ion source is brighter (i.e., delivers more ions to the mass analyzer per unit time) and takes only 1 msec to inject the target number of ions. In this case, pipelining of the scan stages results in only an incremental improvement in the number of scans taken over a fixed period. The opposite case, where the injection takes much longer than the analysis also leads to a minimal improvement.

For data dependent experiments, a list of ion species is constructed based upon an initial survey scan. For each ion species that is to be analyzed in a data-dependent fashion, one can calculate the necessary injection time given the observed ion flux for that ion species, along with a scan range based upon the mass of the ion. Execution of the data dependent scans for these ion species (e.g., MS/MS scans) will normally be done in order of decreasing abundance as observed in the survey scan. This will result most likely in injection times that increase with each subsequent scan, since injection time is inversely proportional to abundance. However, the analysis times for these scans will vary somewhat randomly, since the ion species list is ordered by abundance, rather than mass (which will determine the analysis time in an LIT, since the scan range is based on the mass of the ion species).

Figure 13:
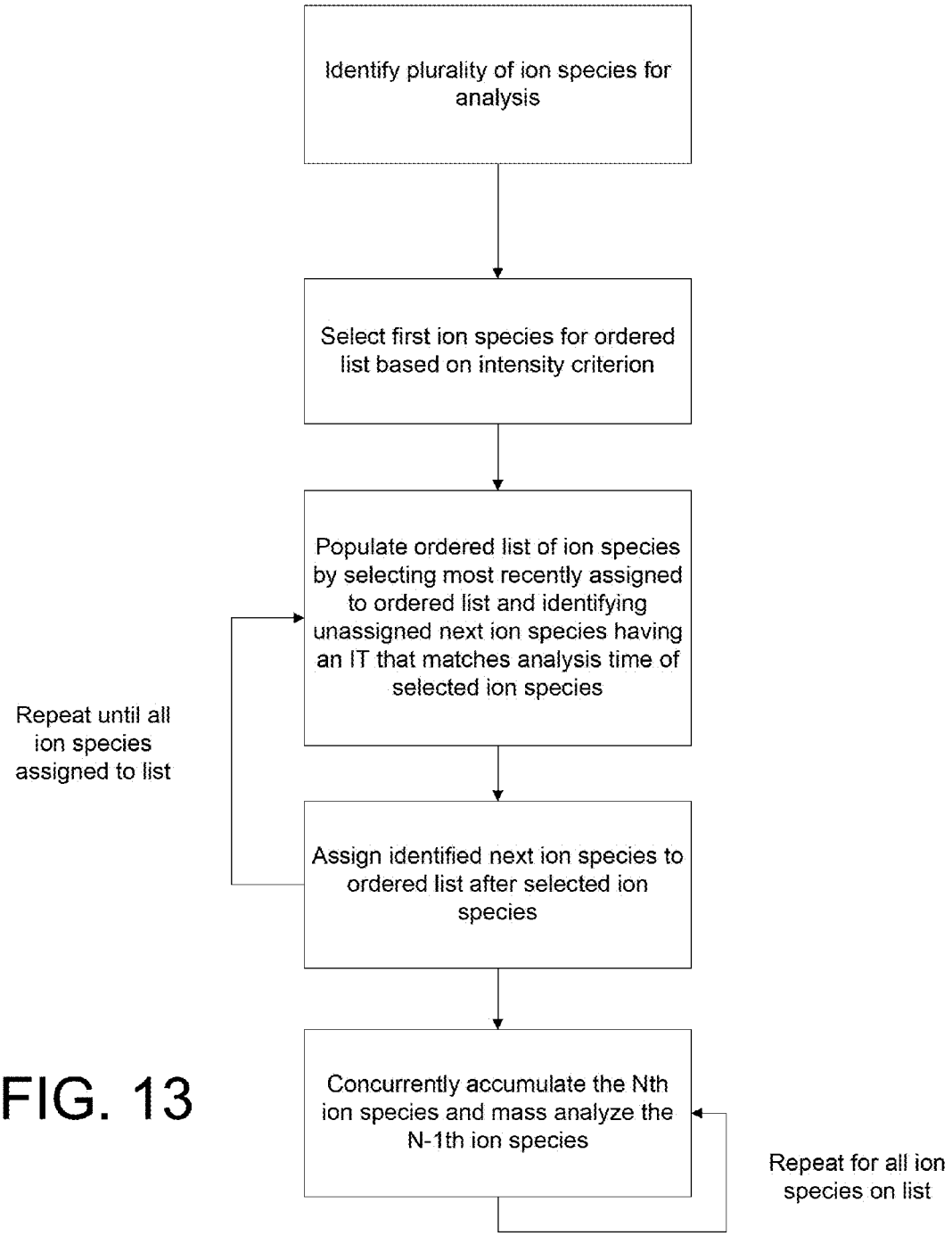
FIG. 13 illustrates the steps of a method for constructing an ordered list of ion species for concurrent operations of accumulation and mass analysis, in accordance with yet another embodiment.

To optimize the efficiency of execution, instead of executing in order of injection time, one could reorder the dependent scans such that they provide the optimal match of injection and analysis times. There are several possible methods by which this can be achieved. If one were to start with the shortest injection for ion species #1, ion species #2 should be selected from the remaining peaks such that its injection time best matches the analysis time of ion species #1. Subsequently, the injection time of ion species #3 should best match the analysis time of ion species #2, and so forth. This method is illustrated by the flowchart depicted in FIG. 13. It is noted that the analysis time for a particular scan may be calculated with reasonable certainty and precision based on the analyzer type and the scan parameters; for scans conducted in the LIT, the analysis time may be calculated based on the scan rate and the scan range (which, as noted above, is based on the mass of the selected ion species); for scans conducted in the Orbitrap analyzer, the analysis time is based primarily on the transient acquisition time (which is set to yield a desired resolution).

More sophisticated algorithms could examine the list of ion species as a whole before the start of the analysis series. Optimizing the order is a specific case of the algorithm referred to as the Travelling Salesman Problem, where one must determine the shortest route for a salesman to travel such that he visits each city once.

Given that the injection times will not always provide a good match to the analysis times, a second option to optimize the execution of the scans is to adjust the acquisition conditions to exploit this mismatch. The most useful example would be the case where the injection times are typically longer than the associated analysis times. In this case, there are almost no detrimental effects associated with extending the analysis time, since the analyzer would otherwise be idle when it completed the current scan. If the ions are to be analyzed with a LIT, one could use a slower scan rate. This slower scan rate provides higher resolution along with potentially improved mass accuracy, if the ions are to be analyzed with an Orbitrap analyzer, one could collect a longer transient. The longer transient also improves resolution; and in most cases will also improve the signal-to-noise ratio.

Conversely, if one had numerous ion species to examine, and injection times were all short, the instrument could reduce the analysis times to increase the scan rate. The reduced analysis time may lead to lower resolution, mass accuracy, or signal-to-noise ratio, but given the quality of current instruments; the data quality will likely still be sufficient to identify the species of interest.

Other mass analysis parameters that could be adjusted to match injection times include ion trap CID activation time, or trap to trap transfer times, both of which increase in efficiency with longer times.

One further adjustment would be to alter the injection times to match the analysis time. A user typically requests an ion target that is sufficient to provide a likely identification of the sample, without spending too much time injecting such that the system is significantly slowed down. Additional ions typically provide improved MS/MS quality up to the point that space charge effects reduce mass accuracy and resolution. So, if injection times are short relative to analysis times, the injection time could be increased, short of the pipelined analysis time, up to some larger value that will result in an improved MS/MS spectrum.

Dynamic Target Adjustment Based on Ion Brightness and Maximal Parallelization

According to the method described below, the AGC target is dynamically scaled "on the fly" based on the precursor ion brightness. This reproducibly produces high quality MS/MS spectra and the best results from the samples with varied complexity and concentration without having to do a priori manual optimization of the MS acquisition method to match the complexity and concentration of each sample.

The architecture of the mass spectrometer described above provides the opportunity to pipeline stages of scan execution. In particular, the initial accumulation of ions for scan N can be done at the same time the ions of scan N−1 are being analyzed. Developing a method to produce data that will enable the identification of the highest number of analytes in a given sample requires striking a balance between optimal scan rate and maximal injection time specific to that sample. In an example, analyzing a high complexity/high concentration sample with a high maximum injection time will result in the acquisition of fewer spectra, although these spectra will be of high quality due to the high number of ions. If the same sample is analyzed with low maximum injection time, there will be many more scans and quality may still be quite good as the sample is high concentration. Conversely, if this same low injection time is applied to a high complexity sample with low concentration, many scans will be acquired, however, the quality will be low. This sample will benefit from increased injection time which will reduce the number of scans but will increase the overall number of identifications.

After sample preparation by the analyst, the true concentration and complexity of the sample is often unknown. Obtaining the highest number of identifications from the samples requires time and sample consuming method optimizations only permitted when sufficient sample/time is available. See FIG. 7 for a graph displaying the effect of ion injection time on number of identifications in a complex sample at varying concentrations.

Traditionally, a user typically requests an AGC target that is sufficient to provide a likely identification of the sample, without spending too much time injecting such that the system is significantly slowed down. More ions would result in higher quality spectra and potentially more fragment ion detection.

To optimize the balance of quality of spectra and scan rate, one could implement a dynamic AGC target system which would take advantage of the parallelization to allow a balance between obtaining the highest quality of data and appropriate scan rate for the given complexity/concentration without sample specific optimization. The user would define an "ideal" AGC target as well as a "minimum" AGC target. The ideal AGC target would be the maximum target you would like to obtain using the time available time during the analysis of the previous ion for maximal parallelization. In the case of ion trap ETD analysis, this would consist of the time required for ETD reaction and ion analysis time (as well as other transfer times, etc.) which can be more than 100 milliseconds in total. The "ideal" target would be high enough to improve MS/MS quality without allowing space charge effects to reduce mass accuracy and resolution. The injection time will only be extended past the time required to analyze the previous ion if the user-defined minimum AGC target has not been met. The extended injection time will only be used to reach the minimum AGC target.

Figure 8:
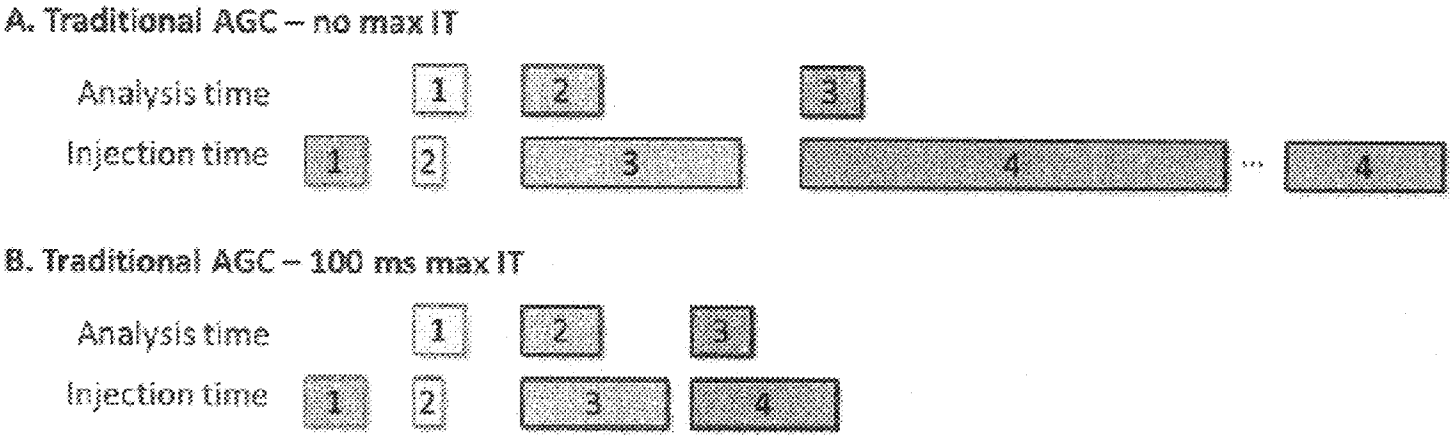
FIG. 8 (PRIOR ART)
FIG. 8 illustrates sequences of accumulation and scan events for different ion species, performed in accordance with prior art methods.

For example, consider the series of scans with a given injection time and analysis time for the defined target using the traditional AGC target of 1e4 (10,000 charges) as shown in Table 1 and FIG. 8A (without max IT, or using a very high max IT) and B (with max IT of 100).

TABLE I

| Traditional AGC | | | |
|---|---|---|---|
| Ion number | target injection time | analysis time | actual injection time |
| 1 | | 35 | |
| 2 | 20 | 53 | 20 |
| 3 | 150 | 42 | 150 |
| 4 | 2800 | | 2800 |

In the case of a very long IT, in practice representing no max IT, some injections will terminate while the previous ion is still being analyzed. The injection could have been continued to increase spectral quality. In other cases, the injection times are extremely long to achieve such a target.

Figure 9:
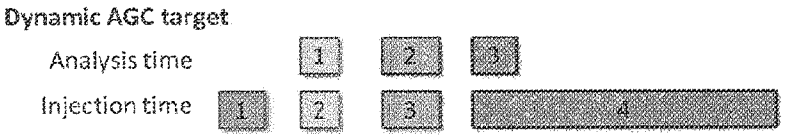
FIG. 9 illustrates sequences of accumulation and scan events for different ion species, performed in accordance with an embodiment of the invention.

With the dynamic AGC target—an evaluation of the current analysis time will be used to establish the injection time and as such the target on a scan by scan basis using an ideal target of 2e4 (20,000 charges) and a minimum target of 1e3 (1000 charges) as seen in Table 2 and FIG. 9. This will effectively use all of the available analysis time to inject the next ion and reduce the length of time required to inject low intensity ions without restricting the injection time of all ions.

TABLE 2

| Dynamic AGC | | | | | |
|---|---|---|---|---|---|
| Ion number | ideal target injection time | minimum target injection time | analysis time | actual injection time | actual target |
| 1 | | | 35 | | |
| 2 | 40 | 2 | 53 | 35 | 1.8E+04 |
| 3 | 300 | 15 | 42 | 53 | 3.5E+03 |
| 4 | 5600 | 280 | | 280 | 1.0E+03 |

Figure 7:
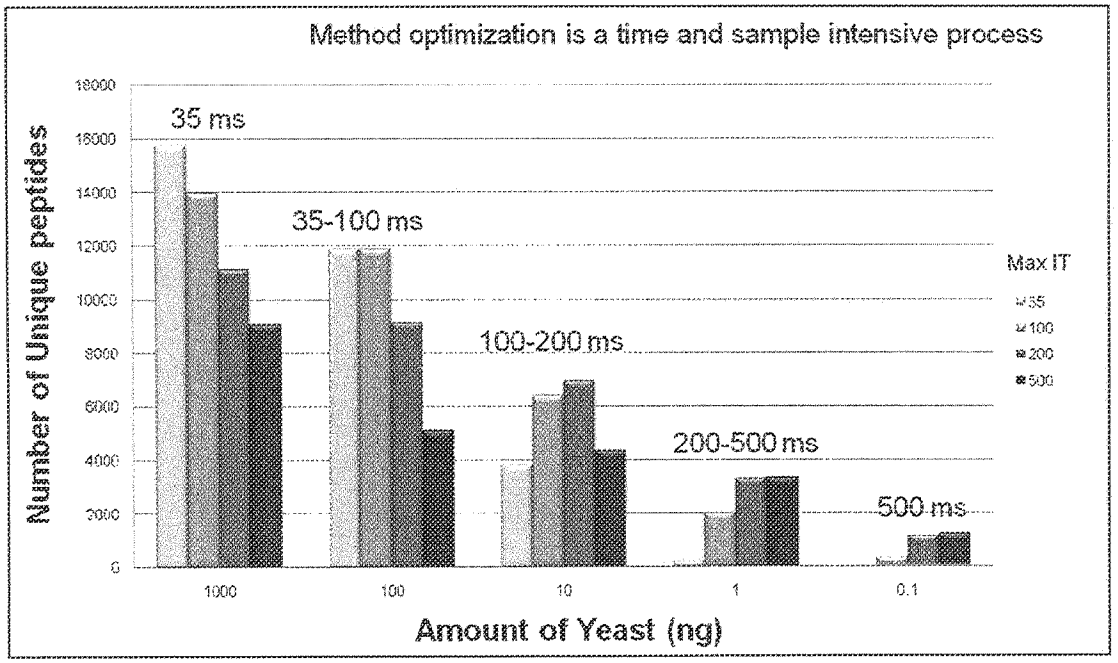
FIG. 7 is a graph showing the effect of ion injection time on the number of peptide identifications in a complex sample at varying concentrations.
Figure 10:
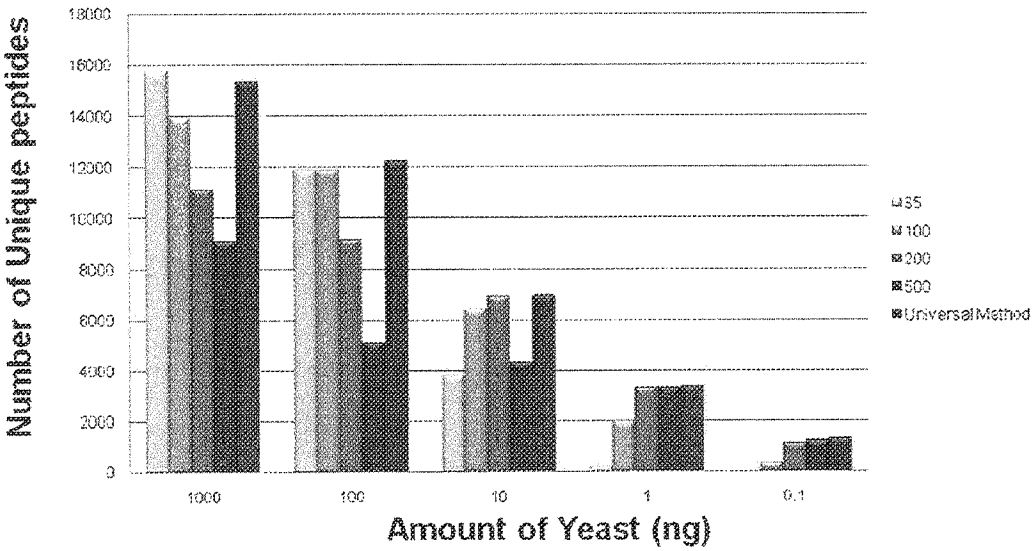
FIG. 10 is another graph showing the effect of ion injection time on the number of peptide identifications in a complex sample at varying concentrations.

When applied to the samples used in FIG. 7, the dynamic AGC target allows the injection times to be effectively extended in low concentration samples improving the quality of spectra and increasing the number of identifications. Using the same method for a high concentration sample allowed the scan rate to remain high with shorter overall injection times. This results is shown in FIG. 10.

In all cases, this one 'universal' method achieved the maximal number of identifications previously obtained where multiple runs were used to optimize the injection time per concentration.

Another situation could be that the user desires to have the highest scan rate possible and restricts the maximum injection time as could be done for extremely high concentrations of sample. Use the 1000 ng sample in FIG. 10 as an example. The maximum injection time of 35 ms is approximately the average analysis time for full parallelization. The actual analysis time is dependent on the fragmentation type, desired scan out rate in addition to the scan out range (precursor dependent) and as such is different for every scan. When the user restricts the maximum injection time to increase the scan rate it may be shorter than the analysis time. If the maximum injection time is met and analysis time for the previous ion still remains, the injection time should be automatically extended to inject more ions (up to the ideal target) without going beyond the analysis time.

The foregoing method, while well suited for the systems with parallelized processes, is not restricted to them and can be implemented on the instruments where the processes are run sequentially.

Sorting and Refining the Precursor Ion List for Data-Dependent Analyses

The goal of the overwhelming majority of MS-based proteomics experiments is to maximally identify peptides (and in some cases, simultaneously quantify). In addition to this, the number of peptide identifications in a single run is often the standard for which mass spectrometers of multiple vendors are compared. Optimizing the order of the detected ions for which we perform data-dependent MS/MS can potentially significantly improve our overall number of identified peptides, even without improvement in hardware.

To identify peptides by mass spectrometry, multiple fragmentation techniques can be used—each of which benefit from different ion characteristics including charge state and m/z ratio. The standard peptide identification method would normally run data-dependent MS/MS based on the most intense ions in the full scan MS. Peptides are usually present with multiple charge states and, as a result, will be fragmented redundantly and identified multiple times. Decreasing this redundancy (e.g., only fragmenting a single precursor ion out of the multiple charge states detected) would free up time for the user to fragment additional peptides which were previously unfragmented and as such unidentified.

As different fragmentation techniques benefit from different peptide ion characteristics, simply fragmenting the most abundant charge state of a given peptide precursor is not the best possible way of collecting meaningful data and as a result, fragmenting only a single precursor has not been used successfully in peptide-based proteomics experiments.

Figure 11:
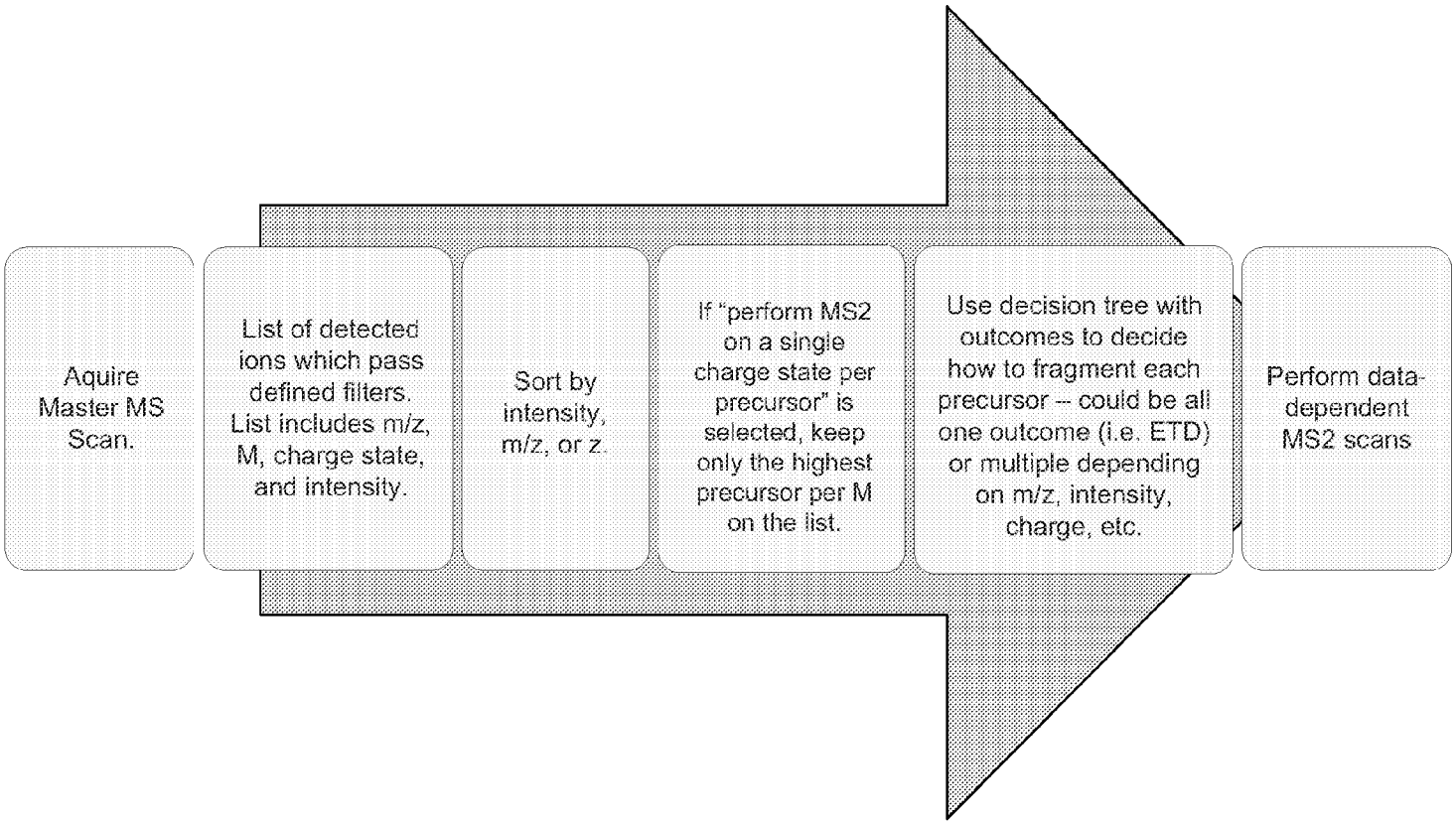
FIG. 11 illustrates the steps of a method for producing a sorted list of precursor ion species and executing data-dependent MS/MS scans, in accordance with another embodiment of the invention.

Optimizing which ion at what charge state is fragmented by which fragmentation technique will increase the identification of peptides. In the case of ETD, fragmentation is most efficient for ions at the lowest m/z (ie. highest charge state of a given molecule). The highest charge state of a given peptide is rarely the most intense, however, will routinely provide more detailed fragmentation data. Here we propose to allow the user to sort the precursor ion list by charge state or m/z, rather than only intensity, permitting MS/MS in the preferred order, e.g., highest charge states first for ETD or lowest charge states first for CID/HCD. In addition to this, we will allow the user to perform MS/MS on only one charge state per precursor reducing the acquisition of redundant, lower-quality spectra to allow analysis of more precursors and ultimately increasing the number of peptides identified in a given run, as depicted in FIG. 11.

It is noted that the determination of charge state of a particular ion species present in a mass spectrum may be performed using a number of techniques known in the art, including but not limited to inspection of the spacing of isotopic variants.

Alternatively customers often desire to identify the maximal number or peptides with the most complete fragment ion coverage possible. This is particularly true for those characterizing post-translational modifications where determining the sequence and positioning of post-translational modification information is essential. When multiple fragmentation types are applied to the same precursor, they often provide complementary sequence information and improved peptide characterization.

Figure 12:
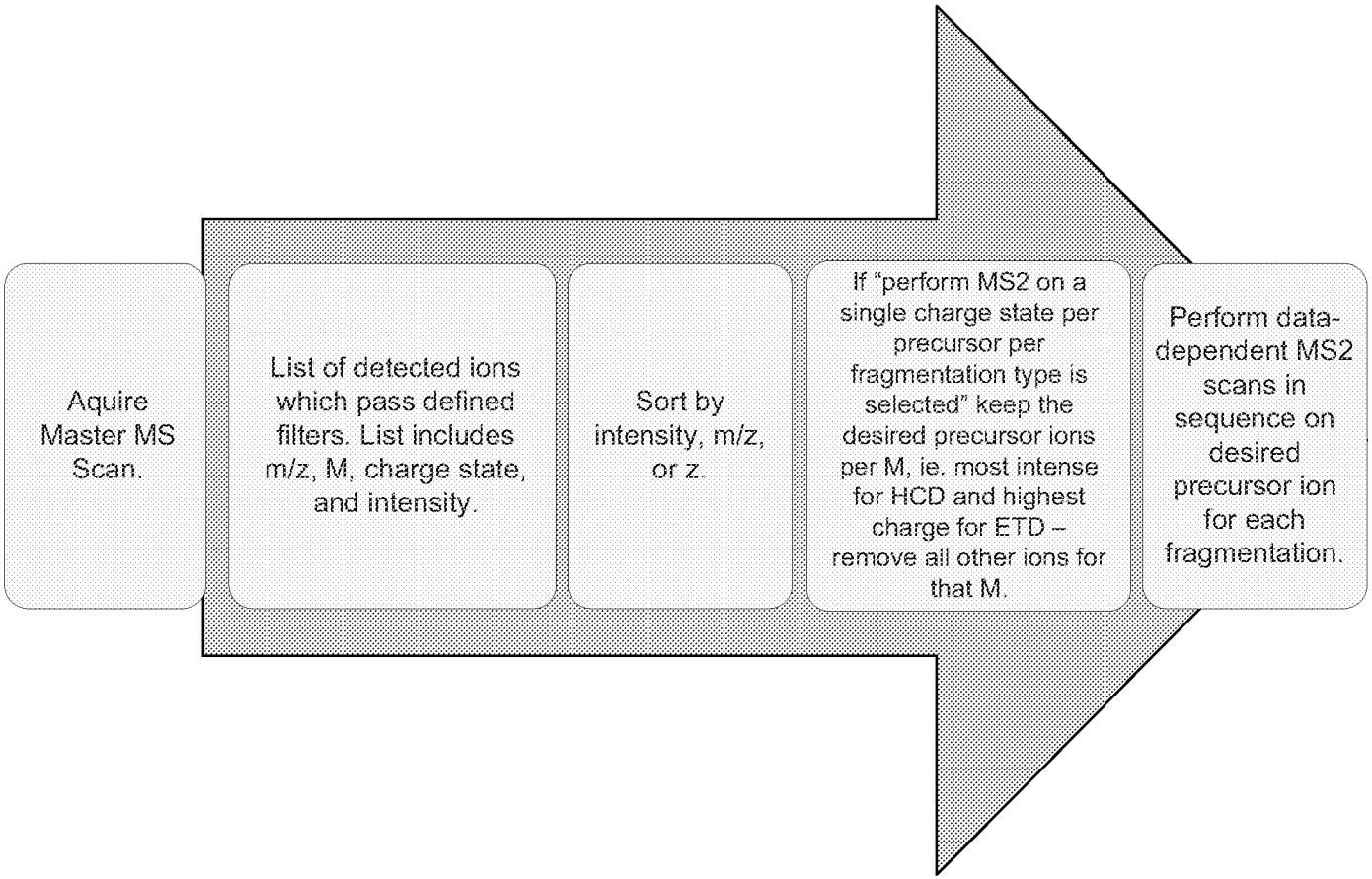
FIG. 12 illustrates the steps of a method for producing a sorted list of precursor ion species and executing data-dependent MS/MS scans, in accordance with still another embodiment of the invention.

The ability to perform multiple fragmentations on a given precursor in certain hybrid instruments could be more intelligently applied if optimal precursors were assigned to each fragmentation type and could significantly improve peptide sequence coverage, without any hardware change. Here we propose to allow the user to use multiple fragmentation types for a given peptide, on preferred charge states based on the desired charge state or intensity for the chosen fragmentation mode. The optimal precursor ions, depending on the fragmentation modes used, will be chosen for each peptide resulting in improved spectral quality and sequence coverage allowing fuller characterization of the peptides. In addition, as only one charge state per fragmentation mode is analyzed, it will reduce the acquisition of redundant, lower-quality spectra allowing the analysis of more precursors and ultimately increasing the number of peptides characterized in a given run, as depicted in FIG. 12.

Several methods for operating a mass spectrometer have been described above. It should be recognized that the foregoing methods may be utilized beneficially with, and readily adapted to, mass spectrometer instrument architectures other than that described above, including but not limited to hybrid mass spectrometers currently available from Thermo Fisher Scientific that incorporate LIT and Orbitrap mass analyzers.

Those skilled in the art will also recognize that features or components of each of the methods described above may be combined with features or components of one or more of the other methods disclosed herein, or with features or components of methods known in the prior art.

It is to be more generally understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A method of performing mass spectrometry analysis in a mass spectrometer instrument having an ion store for accumulating a desired population of ions for subsequent analysis, and a mass analyzer for acquiring a mass spectrum of ions, the accumulation and mass analysis operations occurring concurrently, the method comprising:

identifying a plurality of ion species to be analyzed;

determining, for each one of the plurality of ion species, an associated injection time and an analysis time;

constructing an ordered list of the plurality of ion species by matching the analysis time of each of at least a subset of the plurality of ion species to the injection time of another one of the plurality of ion species; and performing repeated operations of concurrently accumulating in the ion store an Nth ion species on the ordered list and mass analyzing an N−1th ion species on the ordered list, wherein the Nth ion species is one of the plurality of ion species accumulated in the ion store during each of the repeated operations and the N−1th ion species is a different one of the plurality of ion species mass analyzed in the mass analyzer during each of the repeated operations;

wherein the step of constructing the ordered list of the plurality of ion species includes repeatedly performing steps of:

selecting an ion species of the plurality of ion species that has been most recently assigned to the ordered list;

identifying, from a group of ion species that have not yet been assigned to the ordered list, a next ion species of the plurality of ion species having an injection time that most closely matches the analysis time of the selected ion species; and assigning the identified next ion species of the plurality of ion species to the ordered list after the selected ion species;

wherein a first ion species on the ordered list is selected by application of an intensity criterion.

* * * * *